US012722096B2

(12) United States Patent
Barhouche et al.

(10) Patent No.: US 12,722,096 B2
(45) Date of Patent: Sep. 1, 2026

(54) KIT AND METHOD FOR A CONSTRUCTION GAME

(71) Applicant: BILDITS SAL, Sahel Alma Kesrouan (LB)

(72) Inventors: Rayan Barhouche, Sahel Alma (LB); Wael Saade, Kfarhbab (LB)

(73) Assignee: BILDITS SAL, Sahel Alma Kesrouan (LB)

( * ) Notice: Subject to any disclaimer, the term of this patent is extended or adjusted under 35 U.S.C. 154(b) by 12 days.

(21) Appl. No.: 18/584,389

(22) Filed: Feb. 22, 2024

(65) Prior Publication Data

US 2024/0189728 A1 Jun. 13, 2024

Related U.S. Application Data

(63) Continuation of application No. PCT/EP2021/083414, filed on Nov. 29, 2021.

(51) Int. Cl.

| | |
|---|---|
| ***A63H 33/00*** | (2006.01) |
| ***A63H 33/04*** | (2006.01) |
| ***A63H 33/08*** | (2006.01) |

(52) U.S. Cl.

CPC ..... *A63H 33/001* (2013.01); *A63H 33/044* (2013.01); *A63H 33/088* (2013.01); *A63H 33/084* (2013.01)

(58) Field of Classification Search

None

See application file for complete search history.

(56) References Cited

U.S. PATENT DOCUMENTS

| | | | | |
|---|---|---|---|---|
| 1,639,934 A * | 8/1927 | Ferring | ..... | A63H 33/001 425/DIG. 57 |
| 2,274,252 A * | 2/1942 | Tanberg | ..... | B01J 7/02 252/6 |
| 2,309,579 A * | 1/1943 | Duran | ..... | A63H 33/001 249/129 |

(Continued)

FOREIGN PATENT DOCUMENTS

| | | |
|---|---|---|
| FR | 2883506 | 9/2006 |
| GB | 678517 | 9/1952 |

OTHER PUBLICATIONS

Office Action issued in corresponding EP Application 21 823 805.3, issued Feb. 19, 2025, 6 pages.

(Continued)

*Primary Examiner* — Emmanuel S Luk

(74) *Attorney, Agent, or Firm* — Burris Law, PLLC

(57) ABSTRACT

The present disclosure provides a kit for a construction game allowing to construct a structure. The kit includes a plaster powder material, at least one plaster powder container, at least one construction mold, and a packaging. The plaster powder material is configured to be mixed with a liquid solution in order to create a substance in the form of a viscous liquid capable of being solidified later. The plaster powder container is configured to contain the plaster powder material. The construction mold is configured to receive at least a part of the substance in order to create at least one solid predefined construction shape. The solid predefined construction shape is configured so as to be later used to construct the structure. The packaging includes the plaster powder container and the construction mold.

14 Claims, 4 Drawing Sheets

(56) References Cited

U.S. PATENT DOCUMENTS 2,668,999 A * 2/1954 Bachler ..... B28B 7/02 425/DIG. 57
2,910,737 A * 11/1959 MacMillan ..... A63H 33/107 D25/19
2,914,823 A * 12/1959 Bean ..... B22C 9/00 164/332
3,061,880 A * 11/1962 Weisbach ..... B29C 33/306 249/55
4,256,603 A * 3/1981 Ibsen ..... A61K 6/78 522/170
4,763,791 A * 8/1988 Halverson ..... A61C 9/00 433/37
4,764,548 A * 8/1988 Hoppe ..... C09J 101/18 524/270
5,597,593 A * 1/1997 Lebensfeld ..... B29C 33/30 264/318
5,727,979 A * 3/1998 Spector ..... A63H 9/00 446/87
7,670,516 B2 * 3/2010 Rusler ..... A61C 13/01 264/16
10,894,342 B2 1/2021 Arendt
11,472,112 B2 * 10/2022 Momose ..... B33Y 10/00
2002/0030302 A1 * 3/2002 Cleary ..... B44C 5/02 264/219
2003/0152659 A1 8/2003 McCloskey et al.
2008/0187889 A1 8/2008 Kuhn
2008/0308450 A1 * 12/2008 Tchouangang ..... A61C 19/066 206/570
2009/0159775 A1 * 6/2009 Wu ..... B29D 35/148 249/119
2011/0240064 A1 * 10/2011 Wales ..... C09D 7/65 428/116
2013/0026337 A1 * 1/2013 Svensson ..... A63H 33/086 249/98
2016/0214024 A1 * 7/2016 Kiley ..... A63H 33/084
2017/0136653 A1 * 5/2017 Sun ..... B29C 45/40
2017/0225090 A1 * 8/2017 Dripps ..... A63H 33/14
2018/0117486 A1 5/2018 Mccloskey et al.
2018/0169949 A1 * 6/2018 Momose ..... A63H 3/36
2019/0299492 A1 * 10/2019 Arendt ..... A23G 3/0268
2020/0282323 A1 * 9/2020 MacArthur ..... A63H 33/102
2020/0391131 A1 * 12/2020 Sambati ..... C08L 29/04
2021/0170640 A1 * 6/2021 Tsai ..... A63H 33/001
2022/0025184 A1 * 1/2022 Osnato ..... C08K 3/16
2022/0288502 A1 * 9/2022 Patel ..... A63H 33/084

OTHER PUBLICATIONS

International Search Report issued in corresponding International Application PCT/EP2021/083414, mailed Aug. 25, 2022.

* cited by examiner

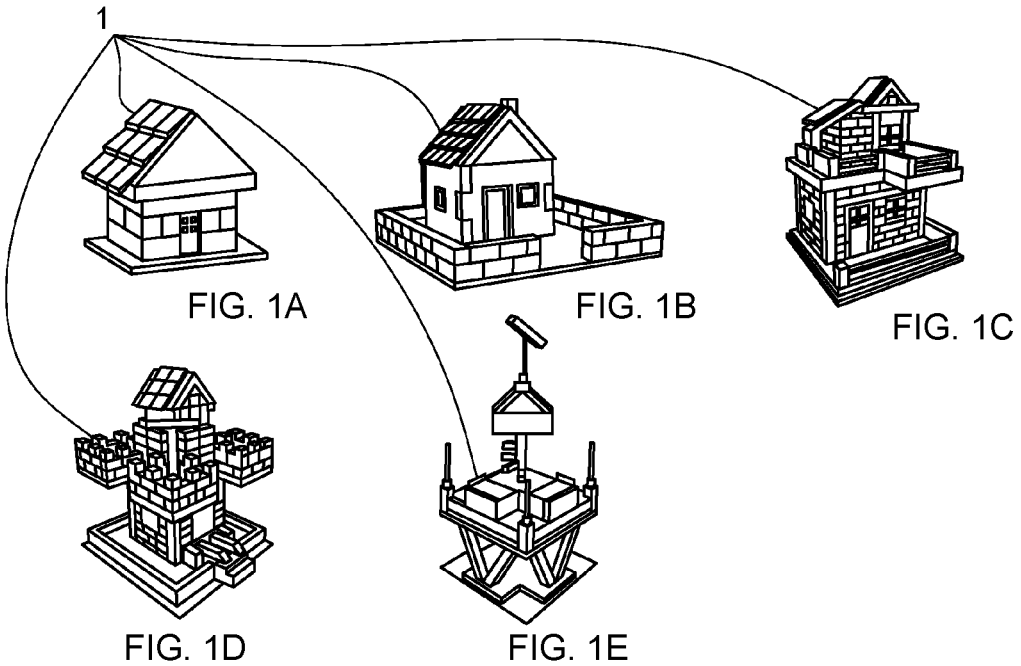
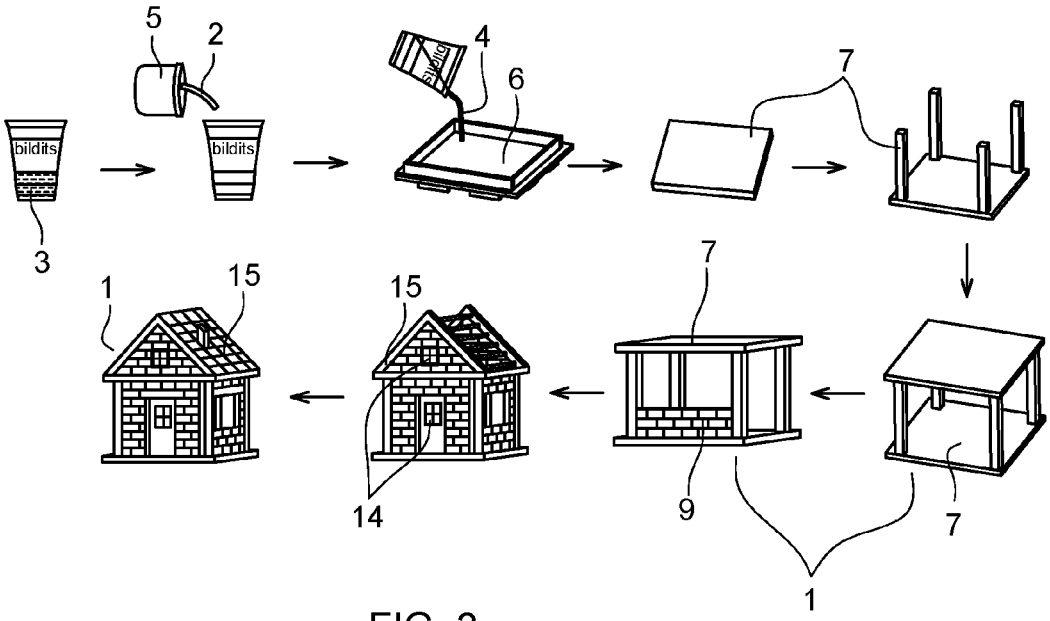
FIG. 2

KIT AND METHOD FOR A CONSTRUCTION GAME

CROSS-REFERENCE TO RELATED APPLICATIONS

This application is a continuation of International Application No. PCT/EP2021/083414, filed on Nov. 29, 2021. The disclosures of the above applications are incorporated herein by reference.

FIELD

The present disclosure relates to a kit for a construction game allowing to construct a structure, as well as a method for constructing a structure by using this kit.

BACKGROUND

The statements in this section merely provide background information related to the present disclosure and does not constitute prior art.

There is an ever-increasing interest in modern urbanism, civil engineering and more generally home design and its construction process among the general public. Construction enthusiasts are engaging in activities that provide them with a learning experience that unlocks and empowers their inner mason or civil engineer.

For these enthusiasts, which include children, scale construction structures would be extremely useful in the understanding of the construction and design process of the structure because they give physical and visual three-dimensional impressions of prospective full-scale structures. Furthermore, the construction of the scale structures needs to be as realistic as possible and the construction materials as close as possible to the actual materials used in full-scale structures. The scale construction experience needs not only to be realistic but also safe for users, and especially for children for whom safety is a major concern.

Moreover, the tools that are used for the construction of those scale structures need to be adaptable to different dimensions and scales. For instance, if a user is building a miniature house, and he needs for that miniature house two slabs of different dimensions, it would be of great interest if he could use the same tools for creating both slabs. This would provide him with both an inexpensive and realistic construction experience.

Many attempts have been made in order to provide users with this kind of realistic experience. For example, patent application US 2008/0187889 A1 discloses a simplified and user-friendly reusable modular building block system, for use by a professional architect or a home design enthusiast, allowing for the creation of custom architectural scale models of building designs similar in appearance and function to professional scale models produced in architects' offices. However, the materials and processes that are involved in US 2008/0187889 A1 require a significant level of skill, time, and expense, and are not suitable nor adaptable methods for children to attempt creating models of their own designs, nor would they provide what needs to be a user-friendly and timesaving experience. Besides, they present safety concerns in the materials they use.

SUMMARY

This section provides a general summary of the disclosure and is not a comprehensive disclosure of its full scope or all of its features.

The present disclosure provides a safe, user-friendly, simple, inexpensive and realistic construction process experience.

The present disclosure provides a kit for a construction game allowing to construct a structure. The kit includes a plaster powder material configured to be mixed with a liquid solution in order to create a substance in the form of a viscous liquid and capable of being solidified later; at least one plaster powder container configured to contain the plaster powder material; and at least one construction mold configured to receive at least a part of the substance in order to create at least one solid predefined construction shape. The one solid predefined construction shape being configured so as to be later used to construct the structure and a packaging including the plaster powder container and the at least one construction mold.

Advantageously, the kit provides a realistic construction experience to users, including users that do not have access to actual construction materials.

Advantageously, the plaster powder material allows obtaining the substance in an inexpensive and easy manner.

Advantageously, the use of the plaster powder material in the kit for the construction game provides more safety, especially when children are using the kit.

Advantageously, the plaster powder material accelerates the solidification of the substance. In some forms, the substance can solidify in approximately 30 minutes.

By constructing a structure, it is meant that the structure is constructed at scale, i.e. structures such as houses, buildings, castles, farmhouses and similar scenarios can be built at a miniature scale so that children can make use of the kit for example.

In one form, the viscous liquid may have a dynamic viscosity between 10 Pascal-second and 100 Pascal-second at reasonably normal atmospheric temperature and pressure conditions. By reasonably normal atmospheric temperature and pressure conditions, it is meant conditions at which temperature values and pressure values vary more or less 30% around their nominal values, i.e. 20 degrees Celsius for the temperature and 1 atmosphere for the pressure.

In another form, the plaster powder container can be a bag, and in particular a plastic bag. The bag can be sealed.

In yet another form, the construction mold can have a circular shape, a rectangular shape, a square shape, a triangular shape or more generally any polygonal shape.

In one form, the solid predefined construction shape can be a slab or a column for example.

In another form, the packaging can be a cardboard packaging, a plastic packaging or any other suitable kind of packaging.

In yet another form, a coloring powder may be added to the plaster powder material in the plaster powder container. In this case, the plaster powder material and the coloring powder are both mixed with the liquid solution in order to create the substance.

In one form, the liquid solution can be an aqueous solution such as water for example.

In another form, the coloring powder to plaster powder ratio in the plaster powder container may be between 1% and 20%.

According to one form, the kit may also include at least one steel mesh. The steel mesh configured to be inserted in the substance in order to replicate the presence of steel columns in a real construction.

According to another form, the construction mold includes at least a first molding part and a second molding part interlocked one with another using a locking system.

Advantageously, interlocking the two molding parts one with another using a locking system provides that the construction mold can have different shapes and that the construction mold will keep its shape after receiving the substance. The at least two molding parts can be rods, for example.

According to yet another form, the first and second molding parts are configured to be dismantled and reused in order to create another construction mold. Advantageously, dismantling and reusing the two molding parts in order to create another construction mold provides that different shapes of the one construction mold can be obtained, and that the kit is reusable and therefore has a better ecological footprint.

According to one form, the locking system is configured such that the first molding part includes a first leg and a second leg. The first leg and the second leg each comprising a tab hole.

According to another form, the second molding part includes fitting holes. The fitting holes configured to receive the first leg and the second leg of the first molding part.

According to yet another form, when the first leg and the second leg of the first molding part are inserted in the fitting holes of the second molding part, the first molding part comes to fit in the second molding part creating therefore a resulting assembly. The resulting assembly between the first molding part and the second molding part is held in place by inserting a blocking tab in the tab holes of the first leg and the second leg of the first molding part when the first molding part is inserted in the second molding part. Advantageously, the locking system of the present disclosure allows interlocking the first molding part and the second molding part one with another in an inexpensive and efficient manner, while reducing the number of components in the locking system.

According to one form, the blocking tab includes a first portion and a second portion. The second portion being assembled to the first portion in a reasonably orthogonal manner such that the assembly of the first portion and the second portion confers a T-shape to the blocking tab. Advantageously, the first portion and the second portion of the blocking tab allows a strong and resistant locking system so that the construction mold shape is maintained despite pouring the substance in the at least one construction mold. Advantageously, the locking system of the present disclosure is inexpensive and environment friendly as the locking system does not include any metal which may not be easily biodegradable.

According to one form, the first portion has a polygonal shape, preferably a semicircular shape. Advantageously, the semicircular or polygonal shape of the first portion improves the safety of the locking system, as the first portion does not include any sharp edges.

According to another form, the first portion is configured to lean on the first molding part when the first molding part is inserted in the second molding part and the blocking tab is inserted in the tab holes of the first molding part.

According to yet another form, the construction mold is made of a synthetic plastic polymer. Advantageously, making the construction mold and the two molding parts of a synthetic plastic polymer provides good strength, desirable flexibility, resistivity, and chemical inertness of the construction mold.

According to one form, the synthetic plastic polymer can be Polyvinyl chloride, abbreviated PVC. The use of synthetic plastic polymer and PVC in particular offers the advantage of a better fire resistance with respect to other materials such as wood for example, therefore providing better safety for the users of the kit.

According to another form, the construction mold is configured so that the solid predefined construction shape is a slab element or a column element usable in the structure to be constructed.

According to yet another form, the kit includes at least one solid construction brick in the packaging. The solid construction brick being configured to be later used to construct the structure.

According to one form, the solid construction brick is fabricated by pouring part of the substance in at least one brick mold that may or may not be included in the kit. Advantageously, the brick mold helps create solid construction bricks in order to make the construction game more realistic.

According to another form, the brick mold is made of an elastomer. Advantageously, the elastomer is flexible and has a deformable shape which helps to easily remove the solid construction brick from the brick mold.

According to yet another form, the elastomer can be silicone for example.

According to one form, the kit further includes an adhesive paste configured to be spread between at least two adjacent solid construction bricks in order to hold them together when they are stacked one on top of the other. The adhesive paste includes a water-based acrylic substance. Advantageously, the water-based acrylic substance offers protective and aesthetic finish that can hide surface imperfections. Advantageously, the water-based acrylic substance offers strong adhesion. Advantageously, the water-based acrylic substance is odorless, non-flammable and eco-friendly. Advantageously, the water-based acrylic substance offers good flexibility and crack resistance, good water resistance and vapor permeability, and good durability.

According to another form, the adhesive paste may include aggregates that create a sandy-like textured pattern with a more realistic construction feeling.

According to yet another form, the adhesive paste may have a specific gravity comprised between 1 g/cm3 and 3 g/cm3, preferably between 1.6 g/cm3 and 1.8 g/cm3 at reasonably normal atmospheric temperature and pressure conditions.

According to one form, the adhesive paste may have a drying time between 1 hour and 10 hours, preferably between 3 and 4 hours at reasonably normal atmospheric temperature and pressure conditions.

According to another feature, the adhesive paste has a dynamic viscosity between 10 Pascal-second and 30 Pascal-second, preferably between 13 and 14 Pascal-second at reasonably normal atmospheric temperature and pressure conditions.

According to yet another feature, the adhesive paste has solids by weight ratio between 30% and 95%, preferably comprised between 74% and 78%. Advantageously, the cited values of dynamic viscosity and solids by weight ratio provide that the adhesive paste can be easily spread in order to hold together the construction bricks in an efficient manner.

The present disclosure also relates to a method for constructing a structure by using a kit as described before. The method includes the following steps: opening the packaging; opening the plaster powder container in order to extract at least a part of the plaster powder material; mixing the plaster powder material with the liquid solution in order to create the substance in the form of the viscous liquid and capable of being solidified later; pouring at least part of the substance in at least one construction mold of the kit in order to create a plurality of predefined construction shapes; and assembling the predefined construction shapes in order to construct all or part of the structure.

According to one form, the construction mold includes at least a first molding part and a second molding part interlocked one with another using a locking system. The method further includes a step of interlocking the first molding part and the second molding part with one another by using the locking system. The first molding part and the second molding part being configured to be dismantled and reused in order to create another construction mold. Advantageously, the method for constructing a structure by using the described kit can help users have access to a realistic construction experience, including users that do not have access to actual construction materials. For example, children at school will be able to attend construction workshops thanks to the described method.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIGS. 1A-1E illustrate different examples of structures that can be constructed using a kit for a construction game in accordance with the principles of the present disclosure;

FIG. 2 is an illustration of construction steps using the kit in order to obtain one of the structures shown in FIG. 1;

Figure 3A:
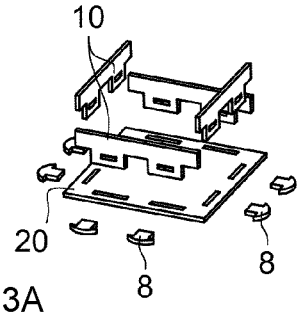
FIGS. 3A-3C illustrate construction steps for constructing a first construction mold obtained by interlocking at least a first molding part and a second molding part using a locking system.
Figure 3B:
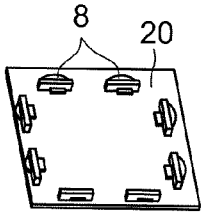
Figure 3C:
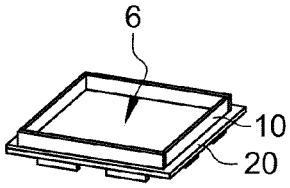
Figure 3D:
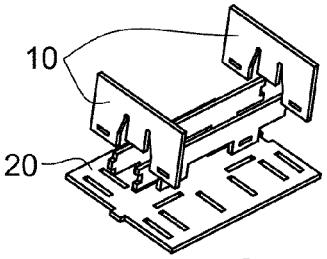
FIGS. 3D and 3E illustrate construction steps for constructing a second construction mold obtained by interlocking at least a first molding part and a second molding part using a locking system.
Figure 3E:
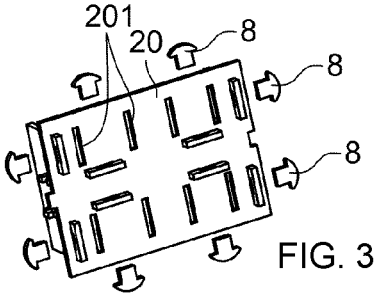
Figure 3F:
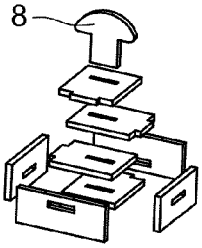
FIGS. 3F and 3G illustrate construction steps for constructing a third construction mold obtained by interlocking at least a first molding part and a second molding part using a locking system.
Figure 3G:
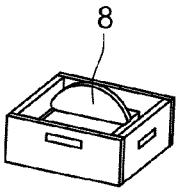

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

By "reasonably normal atmospheric temperature and pressure conditions," it is meant conditions at which temperature values and pressure values vary more or less 30% around their nominal values, that is 20 degrees Celsius for the temperature and 1 atmosphere for the pressure.

By "reasonably orthogonal," it is meant orthogonal with an error margin of more or less 10%.

The present disclosure relates to a kit for a construction game allowing to construct a structure 1 as shown in FIGS. 1A-1E.

By "constructing a structure," it is meant that the structure 1 is constructed at scale, i.e. structures such as houses, buildings, castles, farmhouses and similar scenarios can be built at a miniature scale so that children can make use of the kit for example.

For example, the structure may occupy a total area comprised between 10 $cm^2$ and 1 $m^2$ and may have a height comprised between 15 cm and 1 m.

The kit includes a plaster powder material 2 shown in FIG. 2, configured to be mixed with a liquid solution 3 in order to create a substance 4 in the form of a viscous liquid and capable of being solidified later.

A solidification time for the substance 4 may be between 5 minutes and 2 hours, and preferably around 30 minutes.

The viscous liquid may have a dynamic viscosity between 10 Pascal-second and 100 Pascal-second at reasonably normal atmospheric temperature and pressure conditions and the liquid solution 3 can be an aqueous solution such as water for example.

The substance 4 is configured to replicate a cement used in real constructions, in an inexpensive and safe manner.

Advantageously, the plaster powder material 2 allows obtaining the substance 4 in an inexpensive and easy manner.

Advantageously, the use of the plaster powder material 2 in the kit for the construction game provides more safety, especially when children are using the kit.

Advantageously, the plaster powder material 2 accelerates the solidification of the substance 4, in that the substance 4 can solidify in approximately 30 minutes, which is a relatively short time in comparison with real cement used in real constructions.

The kit also includes at least one plaster powder container 5 shown in FIG. 2, which can be a bag, and in particular a plastic bag that is sealed, configured to contain the plaster powder material 2.

The kit further includes at least one construction mold 6 shown in FIGS. 2, 3A-3H and 4A and 4B and configured to receive at least a part of the substance 4 in order to create at least one solid predefined construction shape 7. The solid predefined construction shape 7 being configured so as to be later used to construct the structure 1.

The construction mold 6 may be made of a synthetic plastic polymer which may be Polyvinyl chloride, abbreviated PVC.

The construction mold 6 may be configured so that the solid predefined construction shape 7 is a slab element or a column element usable in the structure 1 to be constructed.

The construction mold 6 can have a circular shape, a rectangular shape, a square shape, a triangular shape or more generally any polygonal shape.

As an example, the construction mold 6 may have a square shape having each side comprised between 5 cm and 50 cm.

The substance 4 can be directly poured into the construction mold 6 or poured into a pouring element that is connected to the construction mold 6, such as a pouring canal for example.

The kit further includes a packaging having the plaster powder container and the construction mold 6. The packaging can be a cardboard packaging, a plastic packaging or any other suitable kind of packaging.

Advantageously, the kit provides a realistic construction experience to users, including users that do not have access to actual construction materials.

The kit may further include at least one solid construction brick 9 in the packaging. Each solid construction brick 9 being configured to be later used to construct the structure 1.

Each solid construction brick 9 is fabricated by pouring part of the substance 4 in at least one brick mold, that may or may not be included in the kit.

Advantageously, the brick mold helps creating solid construction bricks in order to make the construction game more realistic.

Each brick mold may be made of an elastomer, which may be silicone for example.

Advantageously, the elastomer is flexible and has a deformable shape which helps to easily remove each at least one solid construction brick 9 from the brick mold.

Each solid construction brick 9 may have different shapes including a cube, a prism and a pyramid.

Each solid construction brick 9 may have different dimensions; for example, one solid construction brick may have half the dimensions of another solid construction brick in the same kit.

Each solid construction brick 9 may have the following dimensions for example: a height between 1 cm and 15 cm, a length between 2 cm and 20 cm, and a width between 1 cm and 15 cm.

Additionally, the kit may include at least one miniature lintel.

Each miniature lintel may have the following dimensions for example: a height between 1 cm and 30 cm, a length between 2 cm and 40 cm, and a width comprised 1 cm and 30 cm.

Figure 6:
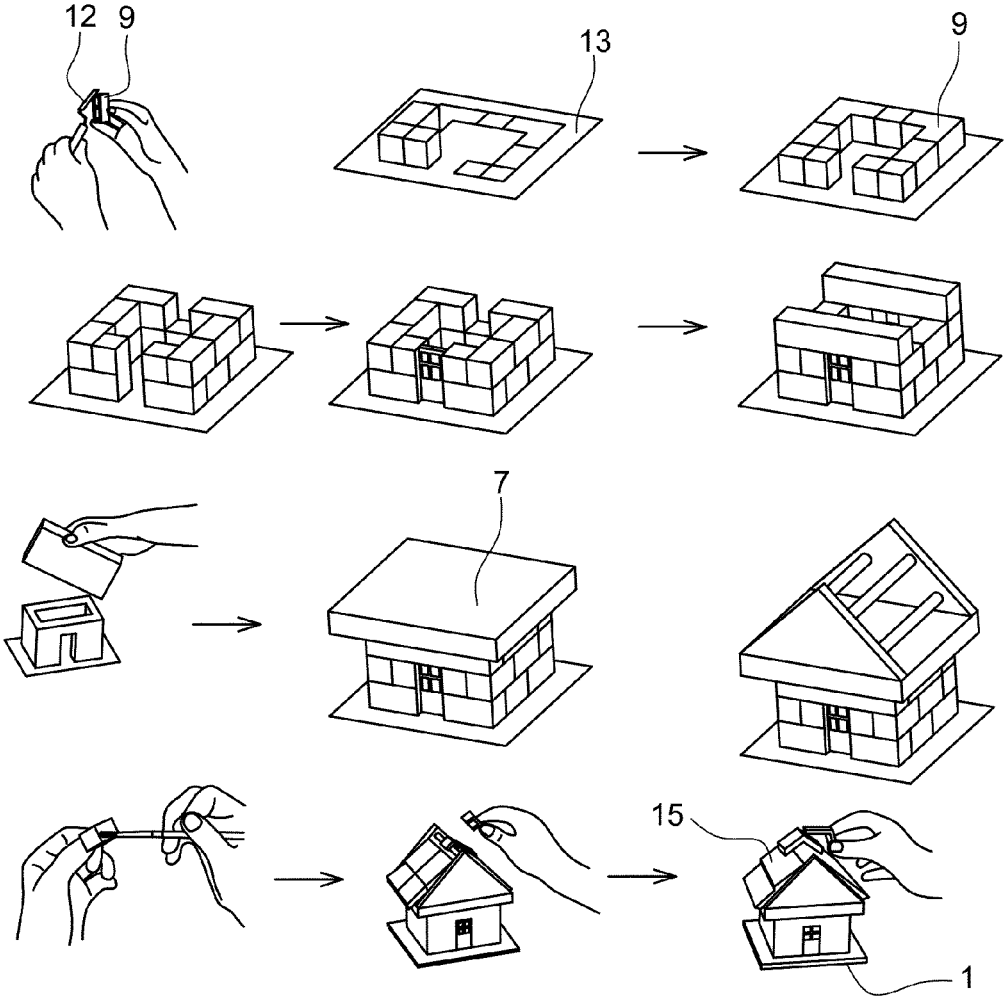
FIG. 6 is an illustration of construction steps for constructing another structure in accordance with the principles of the present disclosure.

The kit may further include an adhesive paste 12 configured to be spread between at least two adjacent solid construction bricks in order to hold them together when they are stacked one on top of the other. The adhesive paste 12 includes a water-based acrylic substance. The spreading of the adhesive paste 12 on the at least one solid construction brick 9 is shown in FIG. 6.

According to one form, the adhesive paste 12 may include 14% of an acrylic based copolymer, 76% of pigment and 10% of water and texture additives.

Advantageously, the water-based acrylic substance offers protective and aesthetic finish that can hide surface imperfections. Advantageously, the water-based acrylic substance offers strong adhesion. Advantageously, the water-based acrylic substance is odorless, non-flammable and eco-friendly. Advantageously, the water-based acrylic substance offers good flexibility and crack resistance, good water resistance and vapor permeability, and good durability. The acrylic based copolymer may for example be acrylic polymer emulsions.

The adhesive paste 12 may include aggregates that create a sandy-like textured pattern with a more realistic construction feeling.

The adhesive paste 12 may have a specific gravity between 1 g/cm3 and 3 g/cm3, preferably between 1.6 g/cm3 and 1.8 g/cm3 at reasonably normal atmospheric temperature and pressure conditions.

The adhesive paste 12 may have a drying time between 1 hour and 10 hours, preferably between 3 and 4 hours at reasonably normal atmospheric temperature and pressure conditions.

The adhesive paste 12 may have a dynamic viscosity between 10 Pascal-second and 30 Pascal-second, preferably between 13 and 14 Pascal-second at reasonably normal atmospheric temperature and pressure conditions.

The adhesive paste 12 has a solids by weight ratio between 30% and 95%, preferably between 74% and 78%.

The cited values of dynamic viscosity and solids by weight ratio provide that the adhesive paste 12 can be easily spread in order to hold together the construction bricks in an efficient manner.

According to one form, a coloring powder may be added to the plaster powder material 2 in the at least one plaster powder container 5. In this case, the plaster powder material 2 and the coloring powder are both mixed with the liquid solution 3 in order to create the substance 4.

The coloring powder to plaster powder ratio in the plaster powder container 5 may be between 1% and 20%.

The kit may also include a base element 13, and in particular a base element 13 on which at least one trace is drawn in order to indicate where the solid construction brick 9 may be placed on the base element 13.

According to a possibility, the adhesive paste 12 may be spread on the solid construction brick 9, and the solid construction brick 9 may be placed on the base element 13 where the at least one trace is drawn.

The kit may also include a door or window element 14 that may be used when constructing the structure 1.

Additionally, the kit may include roof elements configured to be assembled in order to build a roof 15 for the structure 1.

The roof 15, shown in FIG. 2, may be fixed to the structure 1 by using the adhesive paste 12 for example.

The kit may also include a plurality of miniature tiles configured to be put on the roof 15 of the structure 1 as shown in FIG. 6.

Each dimension of every miniature tile of the plurality of miniature tiles may be between 0.5 cm and 20 cm.

Figure 3H:
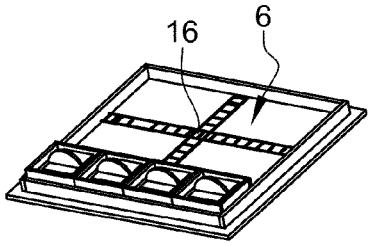
FIG. 3H illustrates a fourth construction mold obtained by interlocking at least a first molding part and a second molding part using a locking system.
Figure 4A:
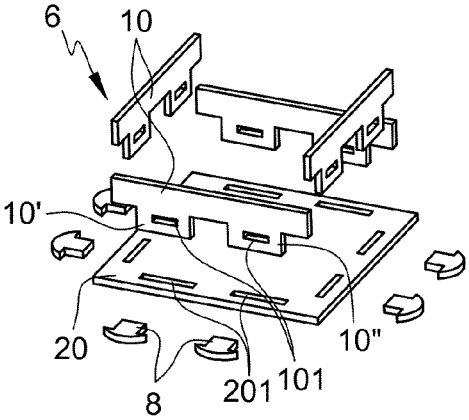
FIG. 4A is an exploded view of the construction mold of FIG. 3C.
Figure 4B:
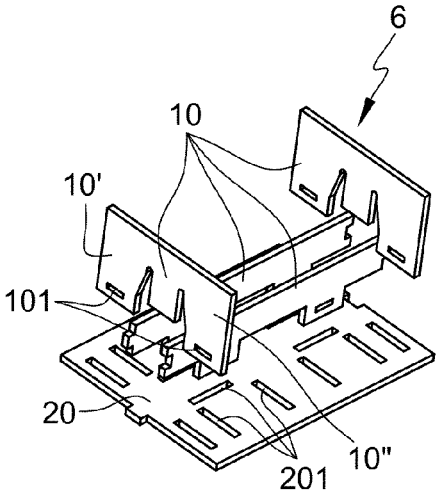
FIG. 4B is an exploded view of the construction mold of FIG. 3E.

According to one form, the kit may also include at least one steel mesh 16 shown in FIG. 3H. The steel mesh 16 being configured to be inserted in the substance 4 before the substance 4 solidifies in order to replicate the presence of steel columns in real constructions.

The kit may further include protection elements such as gloves and miniature construction tools such as a measuring tape, a miniature shovel, a miniature trowel, a stripping tool, a spirit level and at least one grinding paper.

The miniature trowel may be used to separate the solid predefined construction shape 7 from the construction mold 6 once the substance 4 is solidified.

The kit may further include at least one paint container including paint and a brush configured to color the structure 1.

As can be seen in FIGS. 3A-3H and 4A and 4B, the construction mold 6 may include at least a first molding part 10 and a second molding part 20 interlocked one with another using a locking system. Advantageously, interlocking the two molding parts 10, 20 one with another using a locking system provides that the construction mold 6 can have different shapes and that the construction mold 6 will keep its shape after receiving the substance 4. The two molding parts 10, 20 can be rods for example.

The first and second molding parts 10, 20 can be configured to be dismantled and reused in order to create another construction mold. Advantageously, dismantling and reusing the at least two molding parts 10, 20, that is the first molding part 10 and the second molding part 20, in order to create another construction mold provides that different shapes of the construction mold 6 can be obtained, and that the kit is reusable and therefore has a better ecological footprint.

The first and second molding parts 10, 20 can be configured to have adaptable dimensions, so that the user can create construction molds of different dimensions according to the user's needs.

The construction mold 6 can for example include at least one other construction mold of smaller dimensions, allowing therefore to obtain a plurality of solid predefined construction shapes of different dimensions.

The second molding part 20 can have a surface configured to be the inside surface of the at least one construction mold 6. The surface being configured to receive all or part of the substance 4. Furthermore, the surface may be smooth and configured to receive a spread of an oily substance such as oil in order to facilitate the extraction of at least one solid predefined construction shape 7 once the substance 4 is solidified.

The first molding part 10 and the second molding part 20 can have dimensions comprised between 2 cm and 50 cm.

The locking system may be configured such that the first molding part 10 includes a first leg 10' and a second leg 10". The first leg 10' and the second leg 10" each comprising a tab hole 101, and the second molding part 20 includes fitting holes 201. The fitting holes 201 being configured to receive the first leg 10' and the second leg 10" of the first molding part 10, and when the first leg 10' and second leg 10" of the first molding part 10 are inserted in the fitting holes 201 of the second molding part 20, the first molding part 10 comes to fit in the second molding part 20 creating therefore a resulting assembly.

The two molding parts 10, 20 may be made of the synthetic plastic polymer. The synthetic plastic polymer can be Polyvinyl chloride, abbreviated PVC.

The first molding part 10 may fit in the second molding part 20 in a reasonably orthogonal manner.

The first molding part 10 may lean on the second molding part 20 when the first molding part 10 fits in the second molding part 20.

The resulting assembly between the first molding part 10 and the second molding part 20 may be held in place by inserting a blocking tab 8 in the tab holes 101 of the first leg 10' and second leg 10" of the first molding part 10 when the first molding part 10 is inserted in the second molding part 20 as shown in FIGS. 3A-3H and 4A and 4B.

The blocking tab 8 may be inserted in a reasonably orthogonal manner in the tab holes 101 of the first leg 10' and second leg 10" of the first molding part 10 when the first molding part 10 is inserted in the second molding part 20. The blocking tab 8 may be made of a synthetic plastic polymer that may be Polyvinyl chloride, abbreviated PVC.

Advantageously, making the at least one construction mold 6, the two molding parts 10, 20 and the blocking tab 8 of a synthetic plastic polymer provides good strength, desirable flexibility, resistivity, and chemical inertness of the at least one construction mold 6 and the two molding parts 10, 20 and the blocking tab 8. It should be understood that there might be a plurality of blocking tabs 8, and that each blocking tab 8 is to be inserted in a corresponding tab hole 101.

FIGS. 3A-3H and 4A and 4B show an example of the described locking system. Four first molding parts 10 are inserted in the second molding part 20 in a reasonably orthogonal manner and in such a way that the first leg 10' and second leg 10" of every first molding part 10 come to fit in a corresponding fitting hole 201 of the second molding part 20. Eight blocking tabs 8 are then respectively inserted in the corresponding tab holes 101 of each first molding part 10 among the four first molding parts 10, resulting in a construction of the at least one construction mold 6 having a square shape.

Interlocking the first molding part 10 with the second molding part 20 in order to obtain the at least one construction mold 6 is configured to replicate a construction of formworks in real constructions.

Figure 5A:
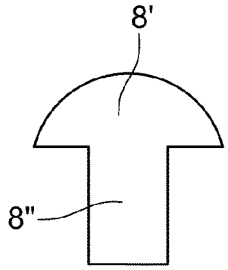
FIG. 5A is a front view of a blocking tab used in the locking system shown in FIGS. 3A-3G and 4A and 4B.
Figure 5B:
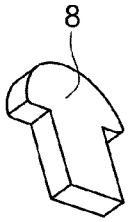
FIG. 5B is a perspective view of the blocking tab used in the locking system shown in FIGS. 3A-3G and 4A and 4B.

The blocking tab 8 may include a first portion 8' and a second portion 8" shown in FIGS. 5A and 5B. The second portion 8" being assembled to the first portion 8' in a reasonably orthogonal manner such that the assembly of the first portion 8' and the second portion 8" confers a T-shape to the blocking tab 8. Advantageously, the first and second portions 8', 8" of the blocking tab 8 allow a strong and resistant locking system so that the at least one construction mold shape 7 is maintained despite pouring the substance 4 in the at least one construction mold 6. The first portion 8' may have a polygonal shape, preferably a semicircular shape. Advantageously, the semicircular or polygonal shape of the first portion 8' improves the safety of the locking system, as the first portion 8' does not include any sharp edges.

The first portion 8' may be configured to lean on the first molding part 10 when the first molding part 10 is inserted in the second molding part 20 and the blocking tab 8 is inserted in the tab holes 101 of the first molding part 10. Advantageously, the described locking system allows interlocking the first molding part 10 and the second molding part 20 one with another in an inexpensive and efficient manner, while reducing the number of components in the locking system. Advantageously, the described locking system is inexpensive and environment friendly as the locking system does not require any metal that may not be easily biodegradable. According to one form, the construction mold 6 and the two molding parts 10, 20 can be made of wood, and the locking system includes a bolted joint, or a metallic screw connection. However, the use of synthetic plastic polymer and PVC in particular offers the advantage of a better fire resistance with respect to wood, therefore providing better safety for the users of the kit.

Figure 7:
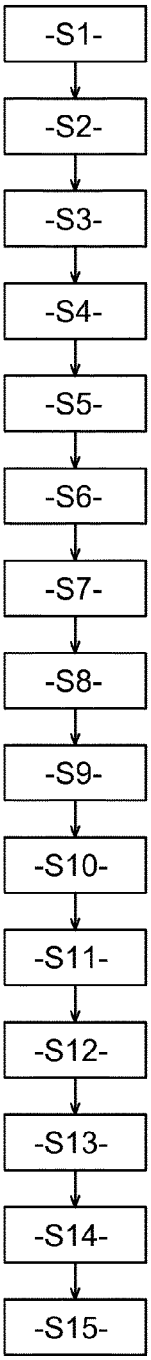
FIG. 7 is a flowchart of a method for constructing a structure by using the kit of FIG. 1 in accordance with the principles of the present disclosure.

The present disclosure also relates to a method for constructing the structure 1 by using the described kit. The method includes the following steps, that are shown in FIG. 7: opening S1 the packaging; opening S2 the at least one plaster powder container 5 in order to extract at least a part of the plaster powder material 2; mixing S3 the plaster powder material 2 with the liquid solution 3 in order to create the substance 4 in the form of the viscous liquid and capable of being solidified later; pouring S5 at least part of the substance 4 in at least one construction mold 6 of the kit in order to create a plurality of predefined construction shapes 7; and assembling S8 the predefined construction shapes 7 in order to construct all or part of the structure 1.

The method may further include a step of interlocking S4 the first molding part 10 and the second molding part 20 with one another by using the described locking system, the first and second molding parts 10, 20 being configured to be dismantled and reused in order to create another construction mold.

The method may further include a step of inserting S6 the at least one steel mesh 16 in the substance 4 when the substance 4 is poured in the at least one construction mold 6 and before the substance 4 solidifies.

The method may further include a step of separating S7 the at least one solid predefined construction shape 7 from the at least one construction mold 6 when the substance 4 is solidified, for example using the miniature trowel.

By assembling the predefined construction shapes 7, it is meant that column elements are fixed in a reasonably orthogonal manner to slab elements as shown in FIG. 2, possibly by attaching the steel mesh to a column element, and by holding the column element in a reasonably orthogonal manner to the at least one construction mold 6 such that a part of the column element attached to the at least one steel mesh 16 leans on the at least one construction mold's inside surface before pouring the substance 4 in the at least one construction mold 6.

The method may further include a step of dismantling S9 the first molding part 10 and the second molding part 20 after the substance 4 is poured in the at least one construction mold 6, and after the substance 4 solidifies. The dismantling the first molding part 10 and the second molding part 20 may possibly occur after a predefined period of time that may be comprised between 20 min and 48 hours.

The method may further include a step of spreading S10 the adhesive paste 12 on the at least one solid construction brick 9, and a step of placing S11 the at least one solid construction brick 9 in the structure as shown in FIGS. 2 and 6.

The method may further include a step of assembling S12 the roof elements in order to obtain the roof 15 for the structure 1, and a step of fixing S13 the roof 15 to the structure using the adhesive paste 12.

When assembling the construction bricks in the structure 1, the user may be offered the possibility of leaving a door space or a window space respectively configured to receive the door or window element 14.

The method may further include a step of placing S14 the plurality of miniature tiles on the roof 15 of the structure 1, and a step of painting S15 the structure 1 using the paint comprised in the paint containers. Advantageously, the method for constructing a structure by using the described kit can help users have access to a realistic construction experience, including users that do not have access to actual construction materials. For example, children at school will be able to attend construction workshops thanks to the described method. The previously described kit and method have an industrial application in the field of construction games. What applies in this detailed description to the kit also applies to the method, and vice versa.

Although the present disclosure has been described in connection with particular configurations, it is obvious that it is in no way limited thereto and that it comprises all the technical equivalents of the means described as well as their combinations if these come within the scope of the present disclosure.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A kit for a construction game allowing to construct a structure, the kit comprising:

a plaster powder material configured to be mixed with a liquid solution in order to create a substance in the form of a viscous liquid and capable of being solidified;

at least one plaster powder container configured to contain the plaster powder material;

at least one construction mold configured to receive at least a part of the substance in order to create at least one solid predefined construction shape, the at least one solid predefined construction shape being configured so as to be later used to construct the structure, wherein the at least one construction mold is configured so that the at least one solid predefined construction shape is a slab element or a column element usable in the structure to be constructed; and a packaging comprising the at least one plaster powder container and the at least one construction mold, wherein the at least one construction mold comprises at least one first molding part and a second molding part, and a blocking tab, the at least one first molding part comprises at least one leg defining a tab hole, the second molded part defines at least one fitting hole, the at least one leg of the at least one first molding part extends through the at least one fitting hole of the second molded part to form a resulting assembly, the blocking tab extends through the tab hole of the at least one leg after forming the resulting assembly.

2. The kit according to claim 1, wherein the at least one first molding part and the second molding part are interlocked using a locking system.

3. The kit according to claim 2, wherein the at least one first molding part and the second molding part are configured to be dismantled and reused in order to create another construction mold.

4. The kit according to claim 2, wherein the locking system is configured such that:

the at least one leg of the at least one first molding part comprises a first leg and a second leg, the first leg and the second leg each comprising the tab hole, the at least one fitting hole of the second molding part comprises a plurality of fitting holes, the plurality of fitting holes being configured to receive the first leg and the second leg of the at least one first molding part, and when the first leg and the second leg of the at least one first molding part are inserted in the plurality of fitting holes of the second molding part, the at least one first molding part comes to fit in the second molding part creating the resulting assembly, and the resulting assembly between the at least one first molding part and the second molding part is held in place by inserting the blocking tab in each tab hole of the tab holes of the first leg and the second leg of the at least one first molding part when the at least one first molding part is inserted in the second molding part.

5. The kit according to claim 4, wherein the blocking tab comprises a first portion and a second portion, the second portion being assembled to the first portion in an orthogonal manner such that an assembly of the first portion and the second portion forms a T-shape to the blocking tab.

6. The kit according to claim 5, wherein the first portion has a polygonal shape.

7. The kit according to claim 5, wherein the first portion is configured to lean on the at least one first molding part when the at least one first molding part is inserted in the second molding part and the blocking tab is inserted in each tab hole of the at least one first molding part.

8. The kit according to claim 1, wherein the at least one construction mold is made of a synthetic plastic polymer.

9. The kit according to claim 1, wherein the kit further comprises at least one solid construction brick comprised in the packaging, the at least one solid construction brick being configured to be later used to construct the structure.

10. The kit according to claim 9, further comprising an adhesive paste configured to be spread between at least two adjacent solid construction bricks in order to hold the at least two adjacent solid construction bricks together when the at least two adjacent solid construction bricks are stacked one on top of the other, the adhesive paste comprising a water-based acrylic substance.

11. The kit according to claim 10 wherein the adhesive paste has a dynamic viscosity between 10 Pascal-second and 30 Pascal-second at normal atmospheric temperature and pressure conditions.

12. The kit according to claim 10, wherein the adhesive paste has solids by weight ratio between 30% and 95%.

13. A method for constructing a structure by using a kit according to claim 1, the method comprising:

opening (S1) the packaging;

opening (S2) the at least one plaster powder container in order to extract at least a part of the plaster powder material;

mixing (S3) the plaster powder material with the liquid solution in order to create the substance in a form of the viscous liquid and capable of being solidified later;

interlocking a first molding part of the at least one construction mold with a second molding part of the at least one construction mold pouring (S5) at least a part of the substance in the at least one construction mold of the kit after the first molding part and the second molding part are interlocked in order to create a plurality of predefined construction shapes; and assembling (S8) predefined construction shapes in order to construct all or part of the structure.

14. The method according to claim 13, wherein the at least one construction mold comprises at least one first molding part and a second molding part interlocked one with another using a locking system, further comprising a step of interlocking (S4) the at least one first molding part and the second molding part with one another by using the locking system, the at least one first molding part and the second molding part being configured to be dismantled and reused in order to create another construction mold.

* * * * *